United States Patent [19]

Engel et al.

[11] 4,072,878

[45] Feb. 7, 1978

[54] STARTING AND OPERATING APPARATUS FOR HIGH PRESSURE SODIUM LAMP BALLASTS

[75] Inventors: Joseph C. Engel, Monroeville; Gary F. Saletta, Irwin, both of Pa.

[73] Assignee: Westinghouse Electric Corporation, Pittsburgh, Pa.

[21] Appl. No.: 540,185

[22] Filed: Jan. 10, 1975

[51] Int. Cl.[2] ..... H05B 37/00

[52] U.S. Cl. ..... 315/205; 315/DIG. 5

[58] Field of Search ..... 315/97, 185 R, 187, 315/200 R, 205, 209 R, 209 SC, 227 R, 2.83, DIG. 5

[56] References Cited

U.S. PATENT DOCUMENTS

| | | | |
|---|---|---|---|
| 3,364,386 | 1/1968 | Segawa et al. | 315/DIG. 5 X |
| 3,407,334 | 10/1968 | Attewell | 315/DIG. 5 X |
| 3,676,734 | 7/1972 | Shimizu et al. | 315/200 R |
| 3,679,936 | 7/1972 | Moerkens | 315/205 |
| 3,857,060 | 12/1974 | Chermin | 315/105 X |
| 3,917,976 | 11/1975 | Nuckolls | 315/258 |

*Primary Examiner*—Rudolph V. Rolinec
*Assistant Examiner*—Lawrence J. Dahl
*Attorney, Agent, or Firm*—W. D. Palmer

[57] ABSTRACT

A lighting apparatus which provides for high voltage pulses for starting a high pressure sodium lamp. This apparatus uses a zener diode circuit which provides appropriately timed starting pulses even at relatively low line voltage. The apparatus can be designed to supply either one pulse or two pulses per cycle.

4 Claims, 6 Drawing Figures

STARTING AND OPERATING APPARATUS FOR HIGH PRESSURE SODIUM LAMP BALLASTS

BACKGROUND OF THE INVENTION

This invention relates to high pressure sodium lamps and in particular to circuit arrangements which provide high voltage of pulses for initiating conduction of such lamps.

High pressure sodium discharge lamps generally require a high voltage pulse to initiate conduction. Such a high voltage pulse can be generated, for example, by using a ballast with two windings and using an SCR to discharge a capacitor through one of the windings at a time when there is sufficient voltage across the lamp to sustain conduction.

The commonly used prior art circuit utilized a glow lamp circuit such as shown in FIG. 1 to initiate conduction. In such a circuit the timing for firing the SCR is developed from the voltage across C1 (the capacitor used to store energy) by using R3 and C2 to give a phase shifted (delayed) voltage to G1. When a high enough voltage appears across the glow lamp G1, it breaks down and triggers the SCR. Thus the SCR is triggered by a voltage which is not in phase with the voltage across C1.

Although this prior art circuit functioned satisfactory in many applications, some problems were encountered. First, difficulties were encountered in fabrication of the circuit due to the relatively wide manufacturing tolerance in "break down voltage" of a given type of glow lamp. Secondly, it was found that the starting circuits often did not function at slightly lower than normal line voltages.

SUMMARY OF THE INVENTION

It has been discovered that one of the difficulties in the prior art circuit (failure to function at somewhat lower than normal line voltage) was due to improper timing of the starting pulse. Thus, although there might be sufficient voltage across the capacitor C1 to provide a starting pulse of sufficient energy at some point in the cycle, the energy in capacitor C1 may be insufficient at the time when the circuit is fired because the timing is based on the signal which is not in phase with the voltage across the C1.

It has been discovered that the use of the zener diode to directly sense the voltage across the energy storage capacitor (C1 in FIG. 1) both eliminates the timing problems by eliminating the phase shift in the timing and eliminates the manufacturing tolerance problem, (the manufacturing tolerances of a given type of zener diode being much more accurate than those of glow lamps).

The lighting apparatus of this invention is for connection to the AC voltage source to supply high voltage pulses to initiate conduction of a high pressure sodium lamp and uses a zener diode timing circuit to achieve more appropriate timing. The apparatus comprises a load (comprising a high pressure sodium lamp), a ballast (having first and second windings with at least the first winding connected in series with the load, the ballast load series combination being adapted to be connected across the AC voltage source), an energy storing capacitor connected to said second winding, a solid state switching means connected between said energy storing capacitor and said second winding (which, when caused become conductive, allows the capacitor to discharge through the second winding of the ballast thereby causing a high voltage pulse to be impressed across a lamp), and a zener diode essentially immediately sensitive to the voltage across the energy storing capacitor (when the lamp is in a non-conductive state). The zener diode is connected such that is causes the solid state switching means to become conductive when the zener voltage of the zener diode is exceeded.

BRIEF DESCRIPTION OF THE DRAWINGS

The invention can be best understood by reference to the following drawings, in which.

The aforementioned

DESCRIPTION OF THE PREFERRED EMBODIMENTS

Figure 1:
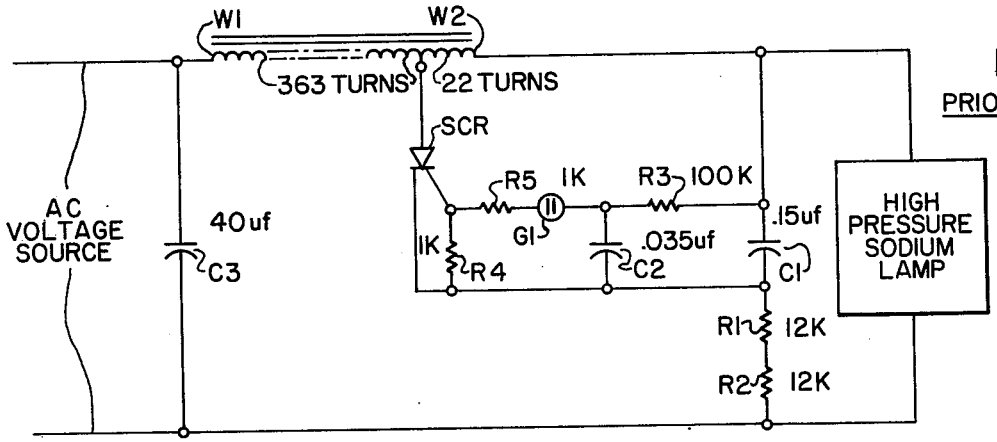
FIG. 1. PRIOR ART
FIG. 1 is a circuit diagram of a prior art circuit.
Figure 2:
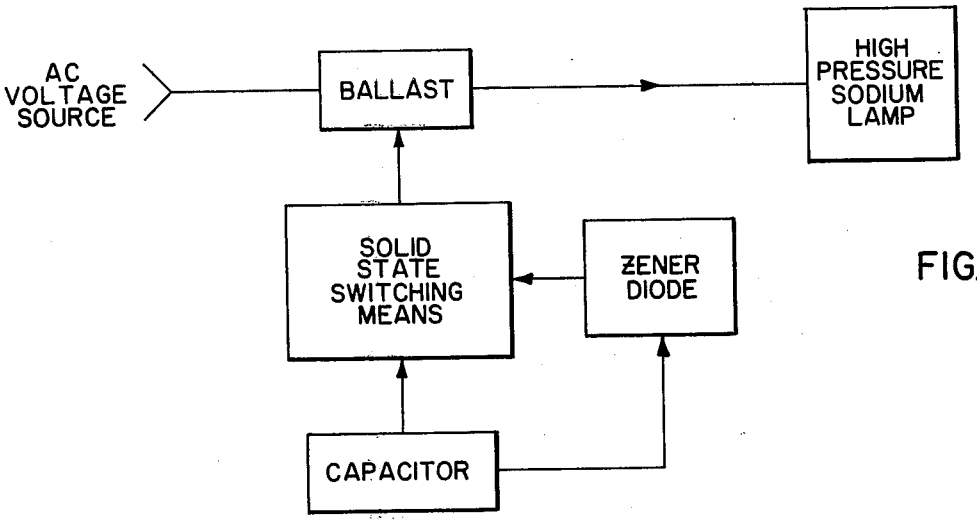
FIG. 2 is a block diagram showing the relationship of elements when the lamp is not conductive.

The block diagram of FIG. 2 shows the relationship between the basic elements of the lighting apparatus of the instant invention. The zener diode monitors the voltage across the energy storing capacitor and, when that voltage exceeds the zener voltage of the zener diode, the zener diode causes the solid state switching means to become conductive and the energy stored in the capacitor to flow into the ballast to generate a high voltage starting pulse for the high pressure sodium lamp. This diagram shows the relationship when the lamp is not conducting and it should be noted that the zener diode need not be connected directly across the capacitor as other elements may be between the zener diode and the capacitor, provided that no significant voltage appears across these other elements when the lamp is not conducting.

Figure 3:
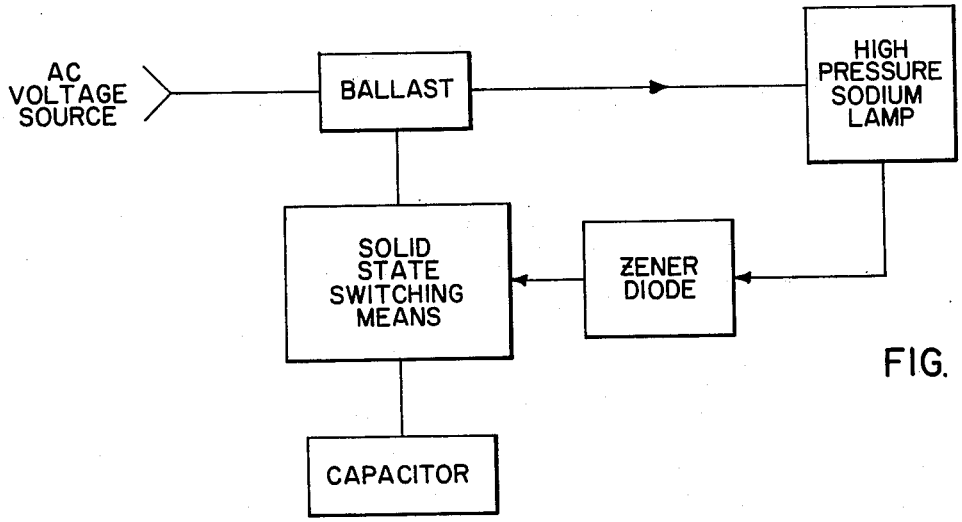
FIG. 3 is a block diagram showing the relationship of circuit elements when the lamp is conductive.

FIG. 3 shows the relationship between the basic elements of the apparatus when the lamp is conducting. When the lamp is conductive, the zener diode is sensitive to the voltage across the high pressure sodium lamp (directly or indirectly) at least to the extent that under most conditions (and preferably all conditions when the lamp is operating) the zener voltage of the zener diode is never exceeded and no starting pulses are generated. When the lamp is conductive the zener diode need not be directly sensitive to the voltage across the lamp but merely needs to be influenced enough to prevent activation of the firing circuit. Thus, if the energy storage capacitor voltage is significantly reduced by conduction of the lamp the zener diode can monitor lamp voltage (indirectly) by monitoring capacitor voltage.

Figure 4:
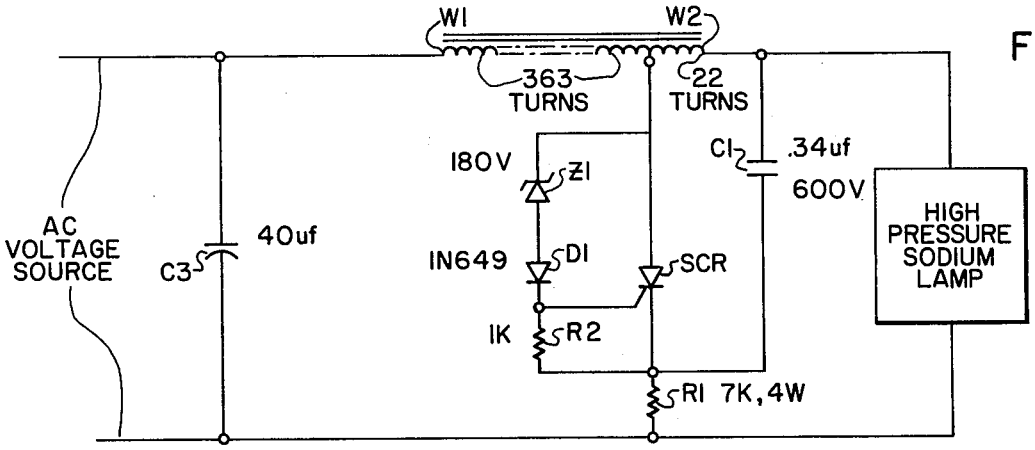
FIG. 4 is a schematic of a preferred configuration using an SCR.

FIG. 4 is a schematic of a preferred configuration using an SCR. Such a circuit will generate only one starting pulse per cycle (as shown, the circuit will generate a starting pulse on the positive half cycle). When the lamp, which is connected across the output terminals is not conducting, the capacitor C1 will start to charge slightly after the start of the positive of the half cycle. When the zener voltage of the zener diode Z1 is reached (180 volts for example) current will flow through Z1 and diode D1 to the gate of the SCR, triggering the SCR and allowing the energy stored in the C1 to flow through the winding W2 which, in conjunction with the winding W1 generates a high voltage pulse across the high pressure sodium lamp. Once the lamp has started conducting, the voltage across C1 no longer rises above the zener voltage of Z1 and further starting pulses are not generated. R1 minimizes the power lost in the starting circuit once the lamp becomes conducting. C3, which is connected across the input terminals is used for power factor correction and R2 provides a path such that SCR is not fired by current leakage through Z1 and D1.

Figure 5:
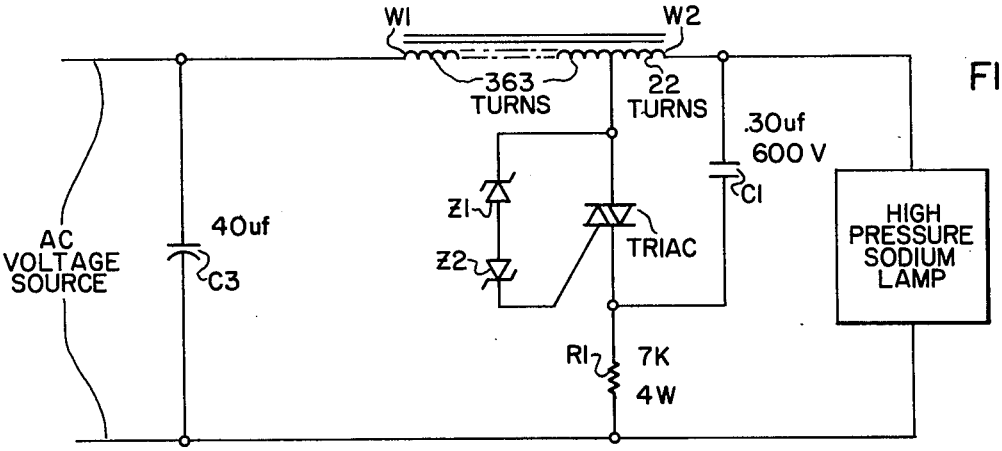
FIG. 5 is a schematic of a preferred configuration using a triac.

FIG. 5 is a schematic of a configuration using a triac (rather than an SCR). The triac circuit will fire on both the positive and negative half cycles and thus provides two starting pules pulses AC voltage source cycle. The operation of the triac circuit in FIG. 5 is generally similar to the operation of the SCR circuit in FIG. 4, except that (in addition to the substitution of the triac for the SCR) two zener diodes Z1 and Z2 or their equivalent (a metal oxide varistor, for example) are required. The energy stored in C1 flows into the ballast winding W2 when the triac is triggered, and this, in conjunction with ballast winding W1 causes a high voltage pulse to be impressed across the high pressure sodium lamp. Although both FIG. 4 and FIG. 5 are typical for 400 watt high pressure sodium lamps, the principles illustrated by these circuits can be implemented by one skilled in the art for other wattages of high pressure sodium lamps. While the circuits of FIGS. 4 and 5 can be used across 120 volt AC lines, some difficulties are incurred. A relatively large energy storage capacitor C1 is required to store sufficient energy at the lower voltage. The larger capacitor, however, then presents a significant alternate path for the starting pulse and thus allows a significant portion of the energy of the starting pulse to bypass the lamp.

Figure 6:
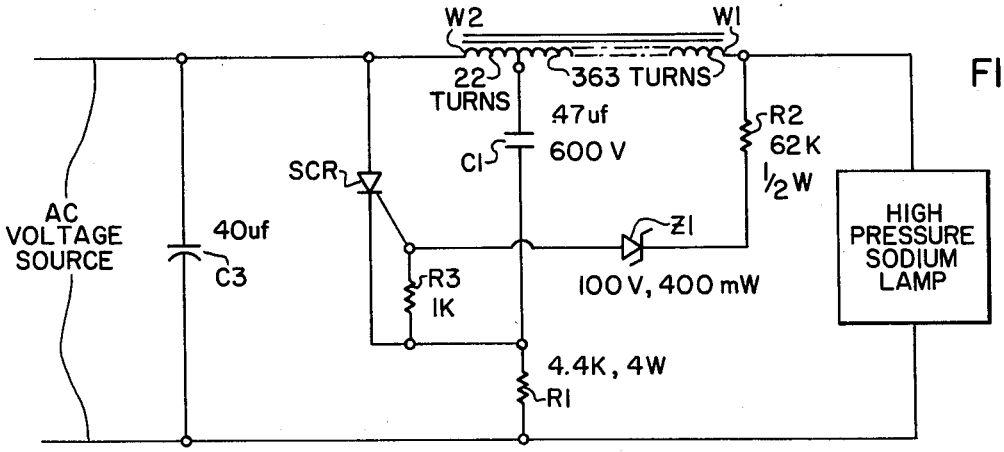
FIG. 6 is a schematic of a preferred configuration which is especially useful in conjunction with a 120 volt AC voltage source.

FIG. 6 is a schematic of a preferred configuration which is especially usefuly on 120 volt line in that the energy storage capacitor C1 is relatively isolated from the starting pulse and thus does not allow a significant portion of the energy of the starting pulse to bypass the high pressure sodium lamp. When the lamp is not conducting there is not a significant voltage drop across either W1 or W2 (the two ballast windings). Thus the zener diode Z1 is directly sensitive to the voltage across the capacitor C1 when the lamp is not conducting and, on the positive half cycle, the diode Z1 will conduct when its zener voltage is exceeded causing the energy of the capacitor C1 to flow through ballast winding W2 to generate the starting pulse. Once the high pressure sodium lamp begins conducting however, there is a significant voltage drop across the ballast windings W1 and W2 and the zener diode Z1 is predominently influenced by the voltage across the lamp. Again, because C1 is located away from the point at which the high voltage appears (the connection between the lamp and ballast), C1 does not allow much of the energy of the high voltage pulse to bypass the lamp. Thus the capacitor C1 (which, in the series with resistor R1) is essentially connected in parallel with the ballast-load series combination and the zener diode Z1 is sensitive to the voltage across the capacitor C1 when the lamp is nonconductive and is sensitive to the voltage across the lamp when the lamp is in a conductive state.

FIGS. 4 and 5 are examples of circuits in which the energy storage capacitor (C1) is in series with a resistor (R1) and this capacitor-resistor series combination is directly connected in parallel with the lamp. In these circuits the zener voltage of the zener diode Z1 (or Z1 and Z2) is generally higher than the voltage across the lamp when the lamp is conducting (thus the high voltage pulses will not be generated when the lamp is conducting).

FIG. 6 is an example of a circuit in which the energy storage capacitor C1 is in series with the resistor R1 and this capacitor-resistor series combination is essentially in parallel with the ballast-load series combination (the first winding W1 of the ballast having at least 10 times the turns of the W2 winding represents the preponderance of the ballast). Thus also in FIG. 6 the zener diode is sensitive to the voltage across the capacitor when the lamp is in a nonconductive state.

I claim as my invention:

1. A starting and operating apparatus for connection across an AC source for starting and then operating a high-pressure sodium discharge lamp, said apparatus comprising:

(a) input terminals adapted to be connected across said AC source, output terminals adapted to have said sodium discharge lamp connected thereacross, a power factor correction capacitor connected across said input terminals, a ballast inductor winding having a tap intermediate the ends thereof, and said ballast inductor connected in series at its ends between one of said input terminals and one of said output terminals, and the other of said input terminals electrically connected to the other of said output terminals;

(b) gate-controlled solid-state switching means connected in series with an energy storage capacitor between one end of said ballast inductor and said ballast inductor tap, resistor means connected between said other input terminal and a point in the line between said series-connected solid-state switching means and said energy storage capacitor, and an additional resistor connecting between gate and cathode of said switching means; and (c) zener diode means, which has a zener voltage greater than the operating voltage for said lamp, connecting across said energy storage capacitor so that the voltage build-up thereacross before said lamp is started is applied across said zener diode means, and said zener diode means also connecting across the gate and anode of said solid-state switching means to gate said switching means when the zener voltage of said zener diode means is exceeded; whereby when said switching means is gated, said energy storage capacitor is discharged through a portion of said ballast inductor to cause the auto-transformer action thereof to apply a lamp starting pulse across said output terminals to start the lamp connected thereacross, and after said lamp is started, the zener voltage of said zener diode means is not exceeded so that the lamp starting portion of said apparatus is rendered inoperative.

2. The starting and operating apparatus as specified in claim 1, wherein gate-controlled solid-state switching means is an SCR.

3. The starting and operating apparatus as specified in claim 1, wherein said gate-controlled solid-state switching means is a triac, said zener diode means is two oppositely connected zener diodes, and said connected zener diodes are connected between said tap on said ballast inductor and said gate of said triac.

4. The starting and operating apparatus as specified in claim 1, wherein said zener diode means has a diode connected in series therewith, with said series-connected zener diode means and said diode connected between said ballast inductor tap and the gate of said solid-state switching means.

* * * * *